US006620035B2

(12) United States Patent
Xu

(10) Patent No.: US 6,620,035 B2
(45) Date of Patent: Sep. 16, 2003

(54) GROOVED ROLLERS FOR A LINEAR CHEMICAL MECHANICAL PLANARIZATION SYSTEM

(75) Inventor: Cangshan Xu, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/040,501

(22) Filed: Dec. 28, 2001

(65) Prior Publication Data

US 2003/0139124 A1 Jul. 24, 2003

(51) Int. Cl.[7] ..... B24B 7/22
(52) U.S. Cl. ..... 451/307; 451/442; 451/59
(58) Field of Search ..... 451/307, 306, 451/303, 296, 297, 442, 173, 168

(56) References Cited

U.S. PATENT DOCUMENTS 2,725,691 A * 12/1955 Sommer et al. ..... 451/303
3,000,149 A * 9/1961 Johnson ..... 451/303
3,668,753 A * 6/1972 Hasegawa ..... 451/442
5,339,570 A * 8/1994 Amundson et al. ..... 451/303

FOREIGN PATENT DOCUMENTS

FR 660361 * 7/1929 ..... 451/296

* cited by examiner

*Primary Examiner*—Robert A. Rose
(74) *Attorney, Agent, or Firm*—Martine & Penilla, LLP

(57) ABSTRACT

In a linear chemical mechanical planarization (CMP) system, a surface of each roller of a pair of rollers is disclosed which includes a first set of grooves covering a first portion of the surface of the roller where the first set of grooves has a first pitch that angles outwardly toward a first outer edge of the roller. The surface also includes a second set of grooves covering a second portion of the surface of the roller where the second set of grooves has a second pitch that angles outwardly toward a second outer edge of the roller with the second pitch angling away from the first pitch. The surface further includes a first set of lateral channels arranged along the first portion, and a second set of lateral channels arranged along the second portion. The first set of lateral channels crosses the first set of grooves, and the second set of lateral channels crosses the second set of grooves.

21 Claims, 8 Drawing Sheets

GROOVED ROLLERS FOR A LINEAR CHEMICAL MECHANICAL PLANARIZATION SYSTEM

BACKGROUND OF THE INVENTION

1. Field of the Invention

The present invention relates to chemical mechanical planarization (CMP) techniques and, more particularly, to the efficient, cost effective, and improved CMP operations.

2. Description of the Related Art

In the fabrication of semiconductor devices, there is a need to perform chemical mechanical planarization (CMP) operations. Typically, integrated circuit devices are in the form of multi-level structures. At the substrate level, transistor devices having diffusion regions are formed. In subsequent levels, interconnect metallization lines are patterned and electrically connected to the transistor devices to define the desired functional device. As is well known, patterned conductive layers are insulated from other conductive layers by dielectric materials, such as silicon dioxide. As more metallization levels and associated dielectric layers are formed, the need to planarize the dielectric material grows. Without planarization, fabrication of further metallization layers becomes substantially more difficult due to the variations in the surface topography. In other applications, metallization line patterns are formed in the dielectric material, and then, metal CMP operations are performed to remove excess metallization.

A CMP system is typically utilized to polish a wafer as described above. A CMP system typically includes system components for handling and polishing the surface of a wafer. Such components can be, for example, an orbital polishing pad, or a linear belt polishing pad. The pad itself is typically made of a polyurethane material or polyurethane in conjunction with other materials such as, for example a stainless steel belt. In operation, the belt pad is put in motion and then a slurry material is applied and spread over the surface of the belt pad. Once the belt pad having slurry on it is moving at a desired rate, the wafer is lowered onto the surface of the belt pad. In this manner, wafer surface that is desired to be planarized is substantially smoothed, much like sandpaper may be used to sand wood. The wafer may then be cleaned in a wafer cleaning system.

FIG. 1A shows a linear polishing apparatus 10 which is typically utilized in a CMP system. The linear polishing apparatus 10 polishes away materials on a surface of a semiconductor wafer 16. The material being removed may be a substrate material of the wafer 16 or one or more layers formed on the wafer 16. Such a layer typically includes one or more of any type of material formed or present during a CMP process such as, for example, dielectric materials, silicon nitride, metals (e.g., aluminum and copper), metal alloys, semiconductor materials, etc. Typically, CMP may be utilized to polish the one or more of the layers on the wafer 16 to planarize a surface layer of the wafer 16.

The linear polishing apparatus 10 utilizes a polishing belt 12 in the prior art, which moves linearly in respect to the surface of the wafer 16. The belt 12 is a continuous belt rotating about rollers (or spindles) 20. The rollers 20 each have a plurality of parallel grooves 30 where a groove direction is parallel to the polishing belt 12 travel direction. The rollers are typically driven by a motor so that the rotational motion of the rollers 20 causes the polishing belt 12 to be driven in a linear motion 22 with respect to the wafer 16. Typically, the polishing belt 12 has seams 14 in different sections of the polishing belt 12.

The wafer 16 is held by a wafer carrier 18. The wafer 16 is typically held in position by mechanical retaining ring and/or by vacuum. The wafer carrier positions the wafer atop the polishing belt 12 so that the surface of the wafer 16 comes in contact with a polishing surface of the polishing belt 12.

FIG. 1B shows a side view of the linear polishing apparatus 10. As discussed above in reference to FIG. 1A, the wafer carrier 18 holds the wafer 16 in position over the polishing belt 12. The polishing belt 12 is a continuous belt typically made up of a polymer material such as, for example, the IC 1000 made by Rodel, Inc. layered upon a supporting layer. The support layer is generally made from a firm material such as stainless steel. The polishing belt 12 is rotated by the rollers 20 which drives the polishing belt in the linear motion 22 with respect to the wafer 16. In one example, an air bearing platen 24 supports a section of the polishing belt under the region where the wafer 16 is applied. The platen 24 can then be used to apply air against the under surface of the supporting layer. The applied air thus forms an controllable air bearing that assists in controlling the pressure at which the polishing belt 12 is applied against the surface of the wafer 16.

FIG. 1C shows an overhead view of the rollers 20 in the linear polishing apparatus 10. During the CMP process, liquid substances such as, for example, slurry or aqueous substances may be applied. Consequently, liquids may come between the rollers 20 and the polishing belt 12 (as shown by the dotted lines). When this happens, hydroplaning may be occur resulting in slippage between the polishing belt 12 and the rollers 20. Such slippage may result in inaccurate and inconsistent polishing of the wafer 16. To help reduce this problems, the rollers 20 have a plurality of parallel grooves 30 that enable liquids to be removed from the contact areas between the rollers 20 and the polishing belt 12. Each of the plurality of parallel grooves 30 are parallel to each other and non-spiraling. Unfortunately, due to each one of the plurality of grooves 30 forming separate, distinct, and unconnected rings around the rollers 20, certain portions of the polishing belt 12 is always over one of the plurality of grooves and is not supported during the rolling of the polishing belt 12.

Because the grooves 30 on the rollers 20 are parallel, the center of the wafer polishing position is lined up with groove sections on both rollers. Without a rigid support such as a stainless steel band, the polishing belt 12 is not evenly stretched across the roller surface. The uneven tension profile directly transfers to the uneven polishing pressure on the belt 12. Because of the parallel pattern on the rollers 20, when the belt 12 is rolling during polish, the uneven tension pattern does not change across the belt 12 (perpendicular to the belt travel direction) at any given time. As the wafer 16 spins, this effect may average out. However, even with the wafer spinning, the center of the wafer 16 always "sees" low pressure, therefore, the removal is the lowest at wafer center.

FIG. 1D shows uneven polish profile is directly transferred to the uneven polishing pressure on the polishing belt 12. The y-axis is a polishing pressure and the x-axis is distance from the center of the wafer 16. Curve 32 shows the distance from the radius of the wafer 16 plotted against the polishing pressure. Because of the parallel pattern on the rollers 20, when the belt 12 is rolling during polishing, the uneven tension pattern does not change across the belt. Due to the lack of support over areas of the plurality of parallel grooves 30, a set of concentric rings separated by, in one example, 0.5" is observed on a polished wafer. Generally, oscillation in removal rate from wafer center to edge corresponds to the rings visually detected on the polishing belt 12. Even if the wafer is spun during polishing, the center of the wafer 16 typically has a minimal polishing rate compared to other areas of the wafer 16.

Therefore, different sections of the polishing belt 12 may have differing tensions which may result in differing polishing rates on certain portions of the wafer 16. Consequently, wafer processing may be less consistent and more wafers may be damaged.

SUMMARY OF THE INVENTION

Broadly speaking, the present invention fills these needs by providing an improved apparatus for rotating a polishing belt in a linear chemical mechanical planarization (CMP) process. The apparatus includes spiral grooves and lateral channels defined on an outside surface of a roller that rotates a polishing belt during CMP. It should be appreciated that the present invention can be implemented in numerous ways, including as a process, an apparatus, a system, a device or a method. Several inventive embodiments of the present invention are described below.

In one embodiment, in a linear chemical mechanical planarization (CMP) system which includes a linear belt and a pair of rollers where the linear belt loops around each of the pair of rollers and the pair of rollers is designed to drive the linear belt to enable planarization of a substrate, a surface of each roller of the pair of rollers is provided. The surface includes a first set of grooves covering a first portion of the surface of the roller where the first set of grooves has a first pitch that angles outwardly toward a first outer edge of the roller. The surface also includes a second set of grooves covering a second portion of the surface of the roller where the second set of grooves has a second pitch that angles outwardly toward a second outer edge of the roller with the second pitch angling away from the first pitch. The surface further includes a first set of lateral channels arranged along the first portion, and a second set of lateral channels arranged along the second portion. The first set of lateral channels crosses the first set of grooves, and the second set of lateral channels crosses the second set of grooves.

In another embodiment, a method for generating a grooved roller for use a linear chemical mechanical planarization (CMP) system is disclosed including providing a roller. The method also includes forming a first set and a second set of grooves on an outside surface of the roller where the first set of grooves covers a first portion of the surface of the roller and the first set of grooves has a first pitch that angles outwardly toward a first outer edge of the roller. The second set of grooves covers a second portion of the surface of the roller, and the second set of grooves has a second pitch that angles outwardly toward a second outer edge of the roller where the second pitch angles away from the first pitch. The method also includes forming a first set and a second set of lateral channels on an outside surface of the roller where the first set of lateral channels is arranged along the first portion, and the second set of lateral channels is arranged along the second portion. The first set of lateral channels crosses the first set of grooves, and the second set of lateral channels crosses the second set of grooves.

In yet another embodiment, an apparatus for optimizing linear chemical mechanical planarization (CMP) operations is provided. The apparatus includes a cylindrical roller where the cylindrical roller rotates a polishing belt in a CMP system. The apparatus also includes a first set of grooves defined on an outside surface of the cylindrical roller where the first set of grooves has a first groove initiation point at a center portion of the cylindrical roller and spirals around the cylindrical roller at least one time to a first ending point at a first edge area of the cylindrical roller. The apparatus further includes a second set of grooves defined on the outside surface of the cylindrical roller where the second set of grooves has a second groove initiation point at the center portion different from the first groove initiation point of the cylindrical roller. The second set of grooves spirals around the cylindrical roller at least one time to a second ending point at a second edge area different from the first edge area of the cylindrical roller. The apparatus additionally includes a plurality of lateral channels being defined on the outside surface of the cylindrical roller where the plurality of lateral channels extends at an angle from the center portion of the cylindrical roller to an edge of the cylindrical roller. The plurality of lateral channels and the first set and the second set of spiral grooves remove fluid from an interface between the cylindrical roller and the polishing belt when the cylindrical roller rotates the polishing belt, and the first set and the second set of spiral grooves apply a consistent tension pattern across a width of the polishing belt when the cylindrical roller rotates the polishing belt.

The advantages of the present invention are numerous. Most notably, by utilizing a spiral grooved roller in accordance with any one of the embodiments of the present invention, the polishing belt will be able to provide more efficient and effective polishing operations over wafer surfaces. Furthermore, because the wafers placed through a CMP operation using the improved roller are polished with better repeatability and more consistency, the CMP operation will also result in improved wafer yields. Specifically, the fluids are removed from an interface between the polishing pad and the roller and at the same time, tension across the width of the polishing pad is made more consistent resulting in optimized wafer processing. Other aspects and advantages of the present invention will become apparent from the following detailed description, taken ink conjunction with the accompanying drawings, illustrating by way of example the principles of the present invention.

BRIEF DESCRIPTION OF THE DRAWINGS

The present invention will be readily understood by the following detailed description in conjunction with the accompanying drawings. To facilitate this description, like reference numerals designate like structural elements.

DETAILED DESCRIPTION OF THE PREFERRED EMBODIMENTS

An invention for an apparatus including a roller with spiral grooves and lateral channels for optimized CMP operations is disclosed. In the following description, numerous specific details are set forth in order to provide a thorough understanding of the present invention. It will be understood, however, by one of ordinary skill in the art, that the present invention may be practiced without some or all of these specific details. In other instances, well known process operations have not been described in detail in order not to unnecessarily obscure the present invention.

In general terms, the present invention is directed toward spiral grooved rollers (also known as drums) with angled lateral channels to enable fluid expulsion from a contact point between a roller and a polishing belt. The spirally grooved roller enables proper fluid removal from an interface between the rollers and the polishing belt while averaging out uneven tension pattern of the polishing belt. It should be appreciated that the present invention may be utilized to correct uneven tension pattern on any type or structure of polishing belt such as, for example, a single layer polymeric pad, the single layer polymeric pad with stainless steel layer, a multilayer pad (e.g., the single layer polymeric pad with a cushioning layer underneath supported by a stainless steel layer), etc. The improved roller with the spiral grooves and the later channels described herein may also be utilized to optimize wafer polishing operations of any size or types of wafers such as, for example, 200 mm semiconductor wafers, 300 mm semiconductor wafers, etc. It should be appreciated that to use the roller in different size wafer operations, the size of the roller is changed. In a preferred embodiment, the roller has two 180 degrees offset spiral grooves with angled lateral channels. In such an embodiment, rollers with a set of spiral grooves may be utilized with a linear CMP system such as the Teres CMP polisher manufactured by Lam Research Corporation of Fremont, Calif. The set of rollers may then be utilized to drive the polishing belt where the grooves on the roller may improve tracking of the polishing belt. The concentric rings that are typically seen on polishing belts utilizing parallel grooves are not seen when spiral grooves are utilized on rollers. The roller of the present invention therefore may optimize CMP operations by eliminating evenly spaced concentric rings are observed on the polished wafer.

Figure 1A:
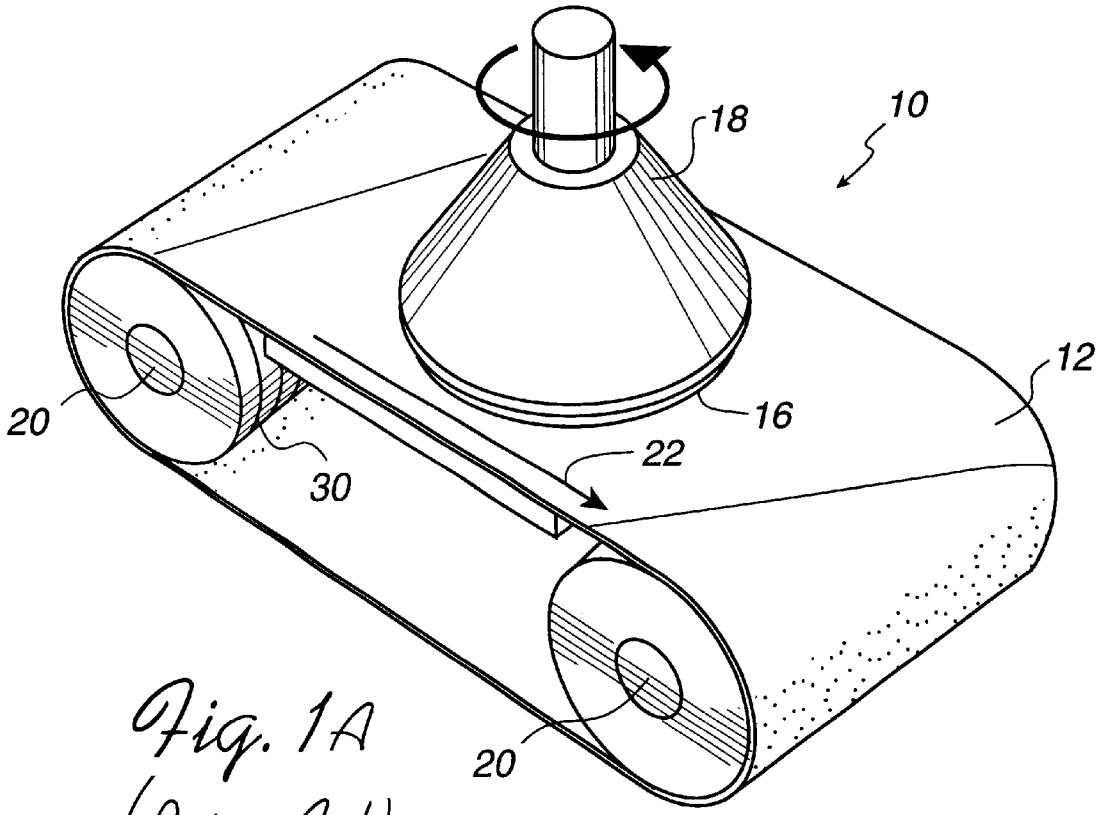
Fig. 1A (Prior Art)
FIG. 1A shows a linear polishing apparatus which is typically utilized in a CMP system.
Figure 1B:
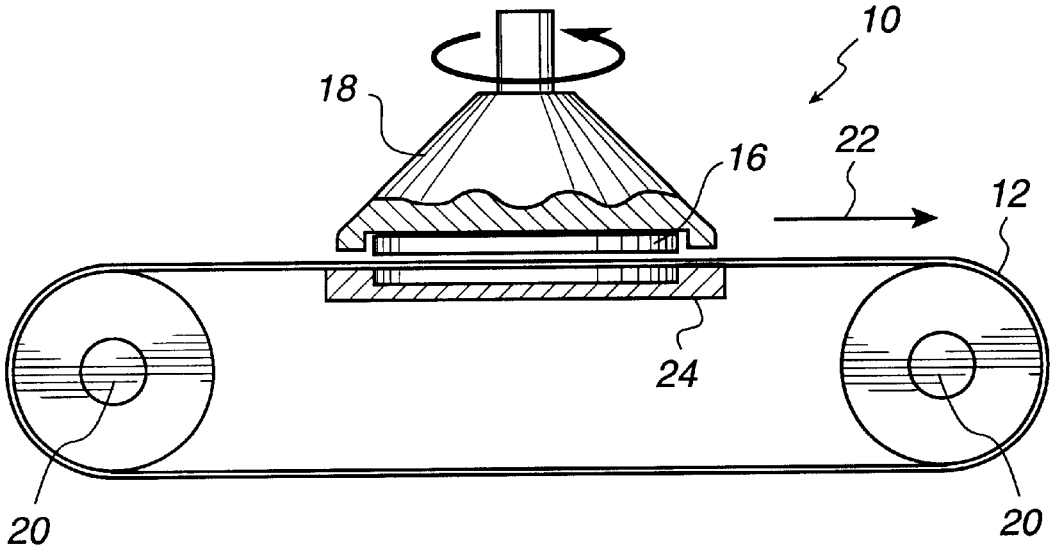
Fig. 1B (Prior Art)
FIG. 1B shows a side view of the linear polishing apparatus.
Figure 1C:
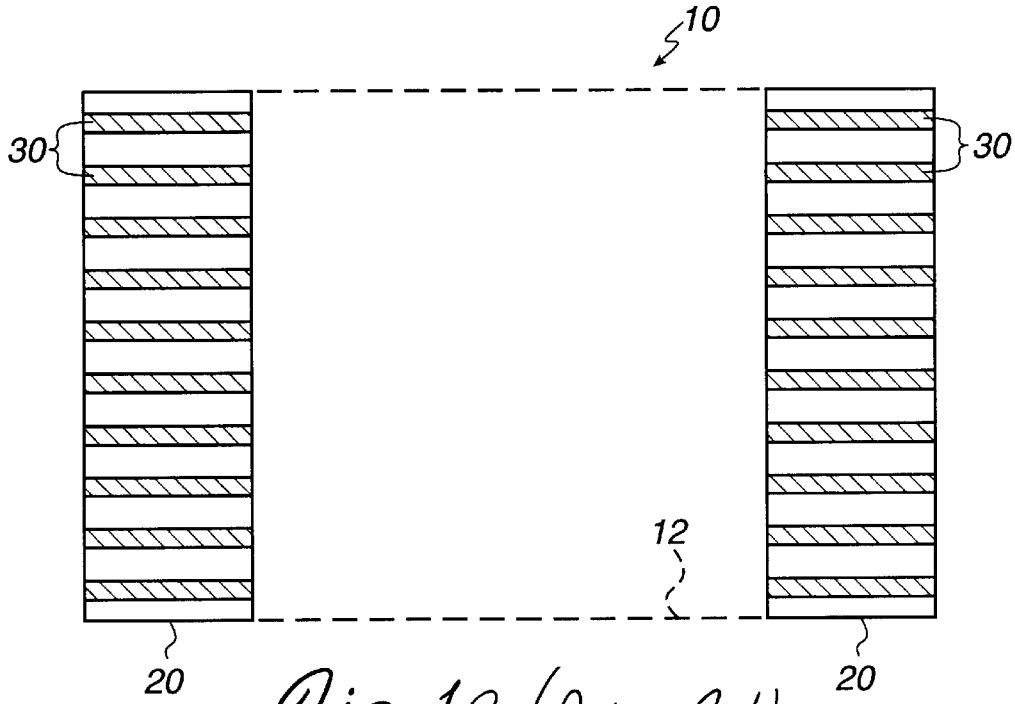
Fig. 1C (Prior Art)
FIG. 1C shows an overhead view of the rollers in the linear polishing apparatus.
Figure 1D:
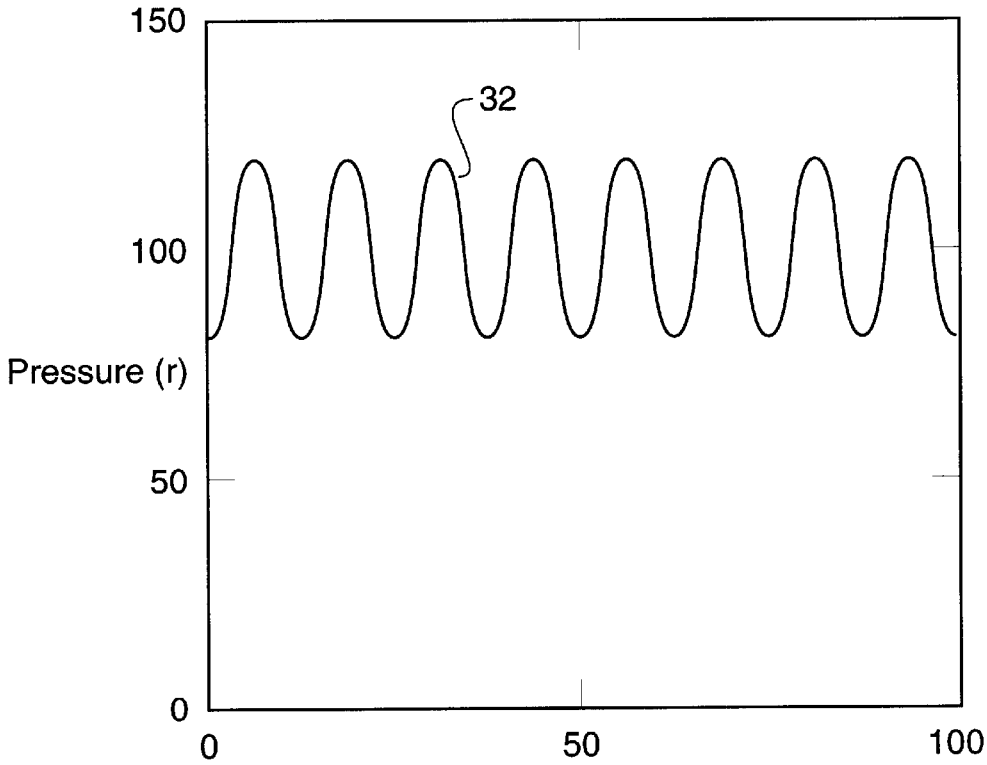
Fig. 1D (Prior Art)
FIG. 1D shows uneven polish profile is directly transferred to the uneven polishing pressure on the polishing belt.
Figure 2A:
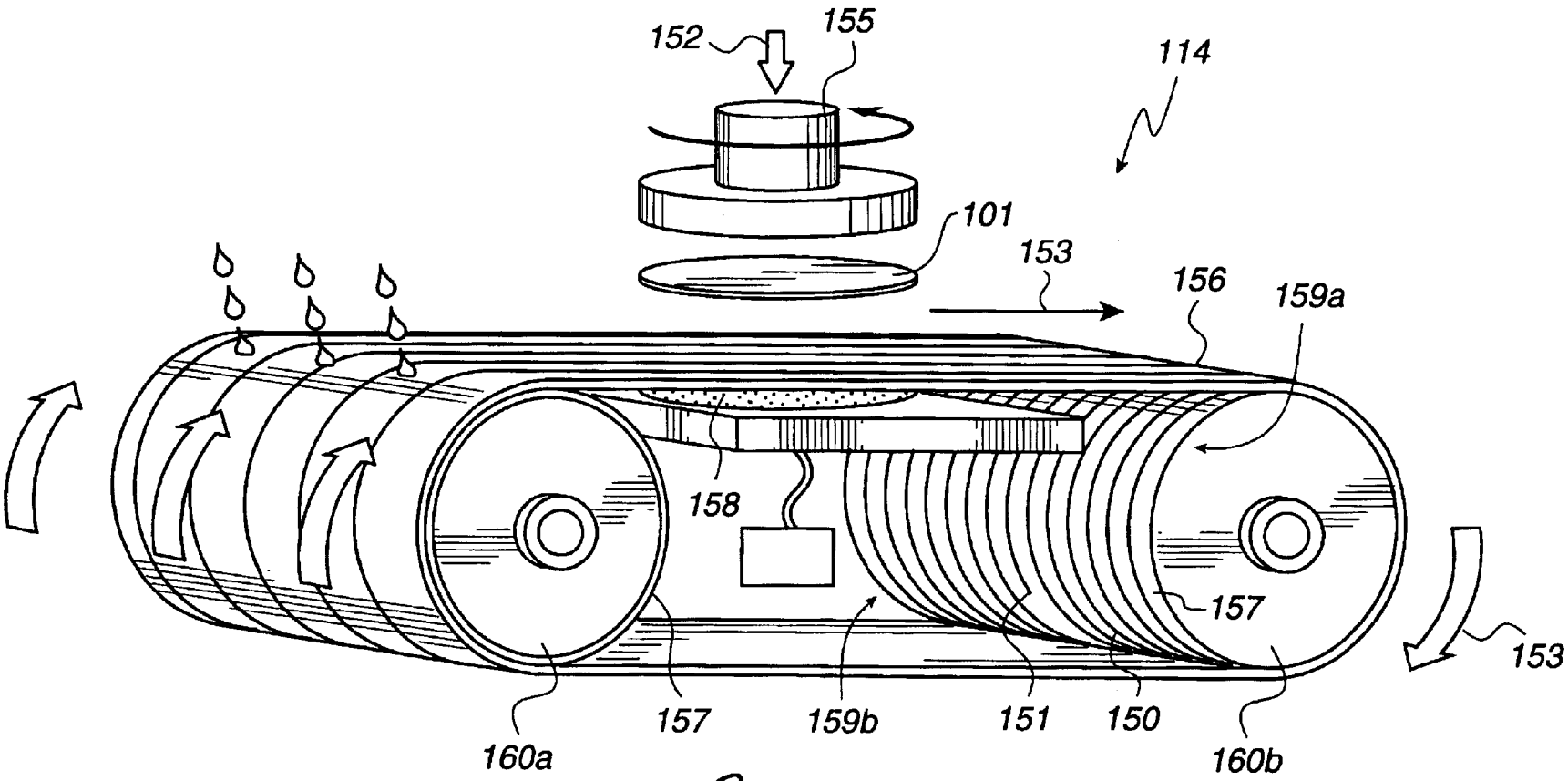
FIG. 2A shows a side view of a CMP system according to one embodiment of the present invention.

FIG. 2A shows a side view of a CMP system 114 according to one embodiment of the present invention. A polishing head 155 may be used to secure and hold the wafer 101 in place during processing. A polishing belt 156 forms a continuous loop around rotating rollers 160*a* and 160*b*. The polishing belt 156 utilized may be made out of any material that may be utilized in CMP operations. In one embodiment, the polishing belt 156 is preferably made of a polymeric material which, in one embodiment, may be polyurethane. In another embodiment, the polishing belt 156 may have a polishing layer and a reinforcement layer such as, for example, a stainless steel layer. In yet another embodiment, the polishing layer may be attached onto a cushioning layer which in turn is attached onto a stainless steel layer.

The polishing belt 156 generally rotates in a direction indicated by an arrow 153 at a speed of about 400 feet per minute. Although, this speed does vary depending upon the specific CMP operation. As the belt rotates, polishing slurry may be applied and spread over the surface of the polishing pad 156. The polishing head 155 may then be used to lower the wafer 101 onto the surface of the rotating polishing belt 156. In this manner, the surface of the wafer 101 that is desired to be planarized is substantially smoothed.

In some cases, the CMP operation is used to planarize materials such as copper (or other metals), and in other cases, it may be used to remove layers of dielectric or combinations of dielectric and copper. The rate of planarization may be changed by adjusting the polishing pressure 152. The polishing rate is generally proportional to the amount of polishing pressure 152 applied to the polishing belt 156 against the polishing pad stabilizer 158. The polishing pad stabilizer 158 may also be referred to as a platen. In one embodiment, the polishing pad stabilizer may use an air bearing. It should be understood that the polishing pad stabilizer 158 may utilize any type of bearing such as, for example, a fluid bearing, etc. After the desired amount of material is removed from the surface of the wafer 101, the polishing head 155 may be used to raise the wafer 101 off of the polishing belt 156. The wafer is then ready to proceed to a wafer cleaning system.

In one embodiment, each of the rollers 160*a* and 160*b* have a plurality of spiral grooves 150 defined on an outside surface 157 (as shown in further detail in reference to FIG. 2B) of the rollers 160 which contacts the polishing belt 156. By having the plurality of spiral grooves 150, as the rollers 160*a* and 160*b* rotate, fluids which may accumulate at an interface between the polishing belt 156 and the outside surface 157 of the rollers 160*a* and 160*b* are removed through the plurality of grooves 150 thereby generating a decrease in slippage due to reduction of hydroplaning. The decrease in slippage therefore reduces wafer damage due to uneven polishing and increases wafer yields which in turn decreases wafer production costs.

In addition, the plurality of spiral grooves 150 on the rollers 160*a* and 160*b* spiral from a middle portion (e.g., a first groove initiation point 151) of the rollers 160*a* and 160*b* to a first ending point in a first edge area 159*a*. A second groove initiation point (not shown, located on an opposite side of the roller shown in FIG. 2A) spirals outward to a second ending point in a second edge area 159*b*. As a result, when the rollers 160*a* and 160*b* rotate during CMP operations, as discussed in more detail in reference to FIGS. 2B and 3A, locations underneath the polishing belt 156 where there is no support (because a groove is underneath that section) move from the center of the polishing belt 156 to the edges of the polishing belt 156. As a result, as the roller rotates, the uneven tension pattern moves across the roller when grooves are spiral. Therefore, an averaging effect automatically takes place during polish and consistent tension pattern is applied across a width of the polishing belt when the cylindrical roller rotates the polishing belt. Therefore, over time, tensions along a width of the polishing belt 156 are consistent. Consequently, because the tension across the width of the polishing belt 156 is made more consistent, the polishing pressures that are applied to the wafer 101 are more consistent.

Figure 2B:
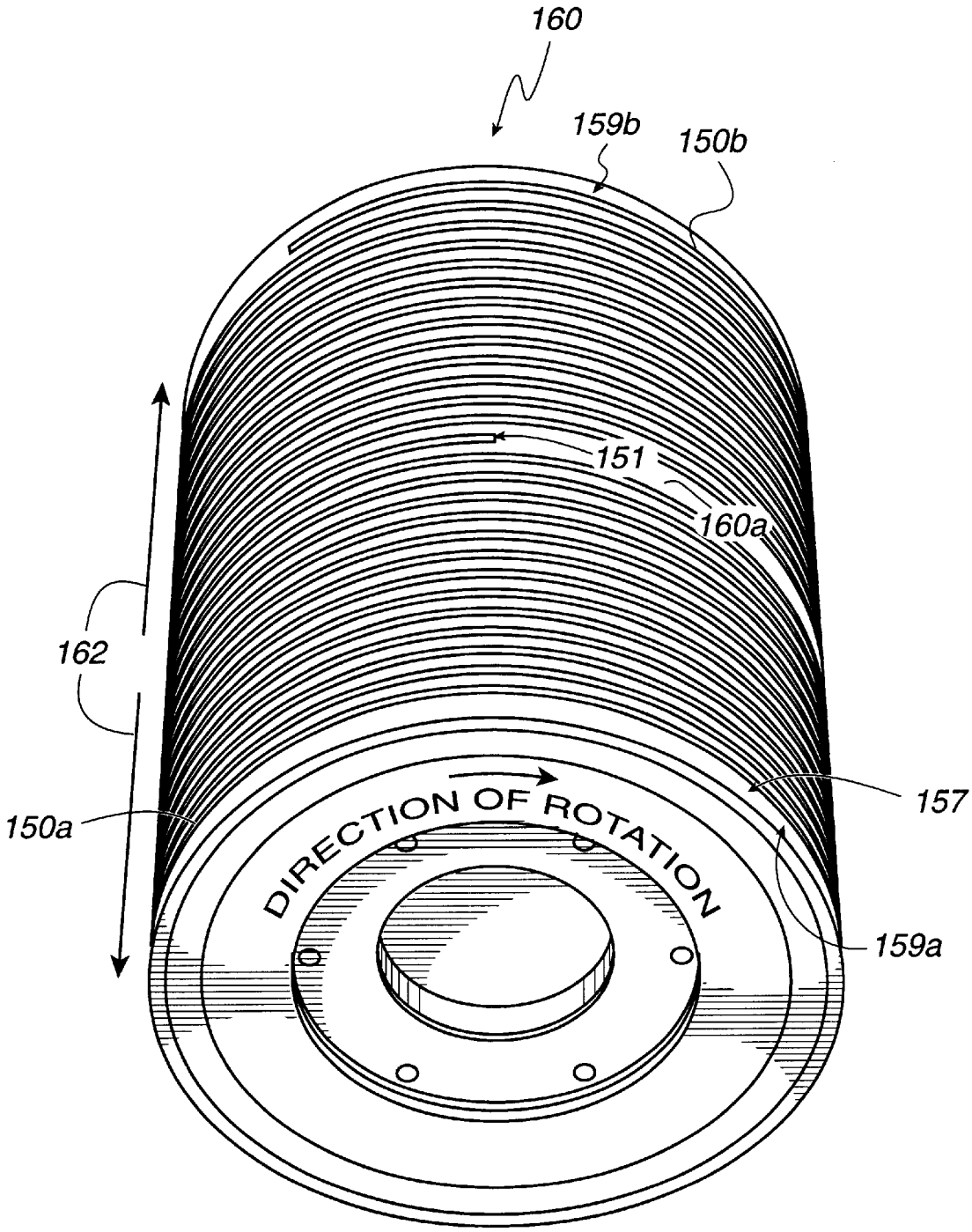
FIG. 2B shows a roller with the plurality of spiraled grooves in accordance with one embodiment of the present invention.

FIG. 2B shows a roller 160 with the plurality of spiraled grooves 150 in accordance with one embodiment of the present invention. It should be appreciated that the roller 160 may be either the roller 160*a* or 160*b* as described in FIG. 2A. In this embodiment, the roller 160 has a first set of grooves 150*a* that spirals outward from a center portion of the roller to the edge area 159*a*. As shown in FIG. 2B, the first set of grooves 150*a* starts spiraling outward from the first groove initiation point 151*a*. The roller 160 also has a second set of grooves 150*b* that is offset 180 degrees from the first set of grooves 150*a* and spirals outward from the center portion of the roller. The second set of grooves 150*b* starts spiraling out from a second groove initiation point (not shown in FIG. 2B) located on the other side of the roller 160. It should be understood that the roller 160 may have any suitable number of spiraling grooves on it, and the sets of grooves may be offset by any suitable amount as long as tension applied to the polishing belt from the roller 160 may be averaged to provide consistent wafer polishing. The first set of grooves and the second set of grooves 150*a* and 150*b* may have any suitable amount of pitch as long as the grooves spiral. The pitch is the amount of angle each of the grooves have with respect to an axis down a polishing belt travel direction. The pitch of the grooves may be between about 0.2 inch to about 2.0 inches. In one embodiment, the first set of grooves 150*a* has a first pitch that angles outwardly toward a first outer edge of the roller, and the second set of grooves 150*b* has a second pitch that angles outwardly toward a second outer edge of the roller where the second pitch angles away from the first pitch.

The grooves 150*a* and 150*b* may be defined on the surface 157 by any suitable way. It should be understood that the grooves can be any suitable shape that would enable removal of water through the grooves 150. In one embodiment, the grooves 150 may be a "V" or a "U" shape. In one embodiment, the grooves 150*a* and 150*b* are machined into an outside surface 157 of the roller 160. It should be understood that the outside surface of the roller 160 may be any type of material that can grip and rotate the polishing belt and that may be manipulated to have grooves that may also retain the grooves. In one embodiment, the surface of the roller 160 may be a polymeric material such as, for example, polyurethane. In another embodiment, the surface of a the roller 160 may be a rubber compound.

The grooves 150 may be any suitable depth as long as water may be evacuated from the interface between the roller 160 and the polishing belt 156. In one embodiment, the depth of the groove is between about 0.05 inch and about 0.5 inch, and preferably about 0.125 inch. In addition, the grooves 150 may be any suitable width as long as enough of the roller material may contact the polishing pad to rotate the polishing pad effectively. In one embodiment, the width of the groove 150 may be between about 0.05 inch and about 0.5 inch, preferably about 0.125 inch.

Because the grooves on the roller 160 of the present invention spiral outward from the center of the roller, when the roller 160 rotates, the grooved portion of the roller 160 that do not contact the polishing belt 156 moves across the width of the polishing pad during wafer polishing as shown by arrow 162. Therefore, as opposed to conventional rollers with parallel non-spiraling grooves where the parallel grooves are distinct and form separate parallel rings around the rollers, the present invention may even out the tension of the polishing belt 156 by averaging out the time a section of the polishing belt is over a grooved portion of the roller 156. This averaging of polishing pad tension generates a more consistent and even wafer polishing profile. This results in much more consistent wafer production and greater wafer yields.

Figure 3A:
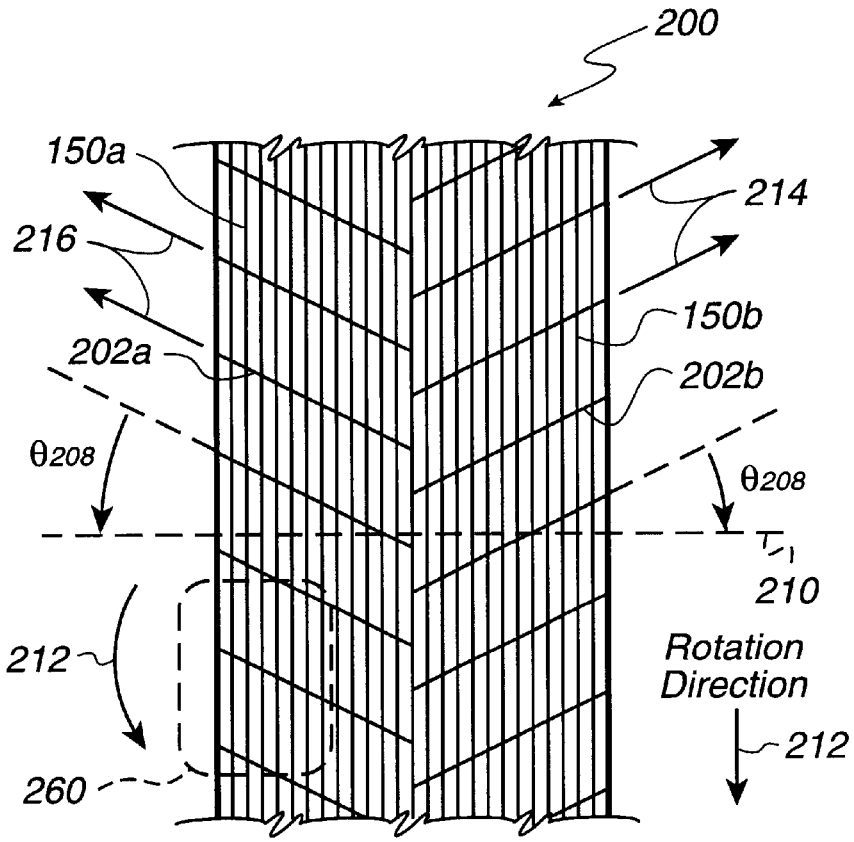
FIG. 3A shows a roller groove pattern with optimized groove patterns on the roller in accordance with one embodiment of the present invention.

FIG. 3A shows a roller groove pattern 200 with optimized groove patterns on the roller 160 in accordance with one embodiment of the present invention. The roller groove pattern 200 may be utilized on either or both of the rollers 160*a* and 160*b* as described in FIG. 2A. The view of the roller groove pattern 200 as shown in FIG. 3 is from a perspective where the circumferential groove pattern is removed from the outside surface of the rollers 160 and shown as a flat sheet. In this embodiment, the roller groove pattern 200 has the first set of spiral grooves 150*a* and the second set of spiral grooves 150*b* as described in reference to FIG. 2B. This embodiment also includes a plurality of lateral channels 202. In one embodiment, the plurality of lateral channels 202 include a first set of lateral channels 202*a* and a second set of lateral channels 202*b*. The first and second sets of lateral channels 202*a* and 202*b* are defined on an outside surface of the cylindrical roller and extend substantially laterally from the center of the most spiral grooves 206. In one embodiment, the first and second sets of lateral channels 202 extend from a center portion of the roller 160 at an angle $\theta_{208}$ from a reference line 210. It should be appreciated that the angle $\theta_{208}$ may be any suitable angle that would enable optimal fluid removal from the interface between the polishing belt 156 and the roller 160. In one embodiment, the angle theta 208 may be between about 0 degrees and about 80 degrees as measured with respect to the reference line 210, and preferably about 30 degrees.

The roller 160 may rotate in a direction 212 so fluids may be removed from along the roller 160 through the first and second lateral channels 202*a* and 202*b* as shown by direction arrows 214 and 216 respectively. A section 260 of the roller 160 with the roller groove pattern 200 is shown in more detail in FIG. 3B. Therefore, in the embodiment as shown in FIG. 3, CMP operations may be optimized by removing fluid that may be utilized in CMP operations away from the interface of the polishing pad and the roller 160. The removal of fluids may be accomplished by having both the spiral grooves and the lateral channels.

Having both types of grooves may be extremely optimal in situations where large amounts of polishing pressure may be utilized in for example copper or tungsten polishing operations. As polishing pressure put on the wafer increases, the ease of rotating the polishing belt decreases. As it becomes more difficult to rotate the polishing belt, the roller requires more grip on the polishing belt. When the friction between the wafer and the polishing pad exceeds the one between the belt and rollers, slippage of the polishing belt from the roller may be common. Therefore, by having both the lateral grooves and spiral grooves on a roller surface, an optimal amount of fluid is evacuated from the interface between the polishing pad and the roller resulting in the roller's grip on the polishing belt being optimized and the chances of slippage greatly reduced.

Figure 3B:
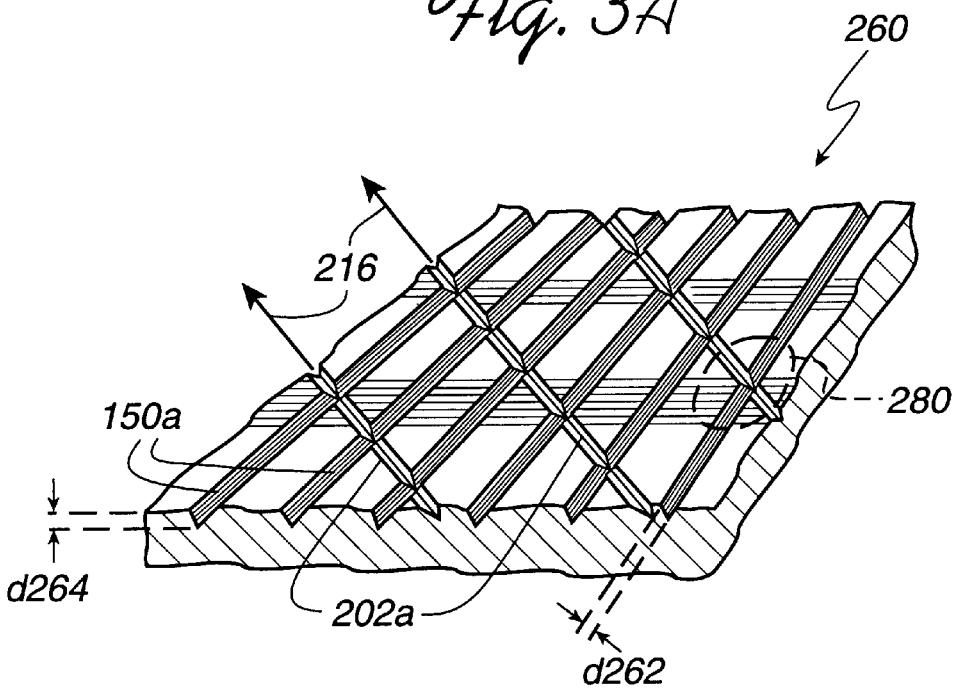
FIG. 3B illustrates a 3-dimensional view of the section as shown in FIG. 3 in accordance with one embodiment of the present invention.

FIG. 3B illustrates a 3-dimensional view of the section 260 as shown in FIG. 3 in accordance with one embodiment of the present invention. The section 260 includes the first set of spiral grooves 150*a* and the first set of lateral channels 202*a*. The section 260 also includes a portion 280 that shows a magnified view of the first set of spiral grooves 150*a* and the first set of lateral channels 202*a*. The section 260 also shows the direction 216 of fluid removal during a CMP operation. It should be appreciated that the lateral channels 202*a* and 202*b* (shown in FIG. 3A) may be any suitable depth that would enable optimal fluid flow away from the outside surface of the roller 160. In one embodiment, the lateral channels 202*a* and 202*b* have a depth $d_{262}$ between about 0.05 inch and about 0.5 inch, and preferably about 0.125 inch.

The depth of the first set of spiral grooves 150*a* and the second set of spiral grooves 150*b* (shown in FIG. 3A) may be any suitable depth that would allow optimal flow away from the outside surface of the roller 160. In one embodiment, the first and second sets of spiral grooves 150*a* and 150*b* may have a depth $d_{264}$ between about 0.05 inch and about 0.5 inch, and preferably about 0.125 inch.

Figure 3C:
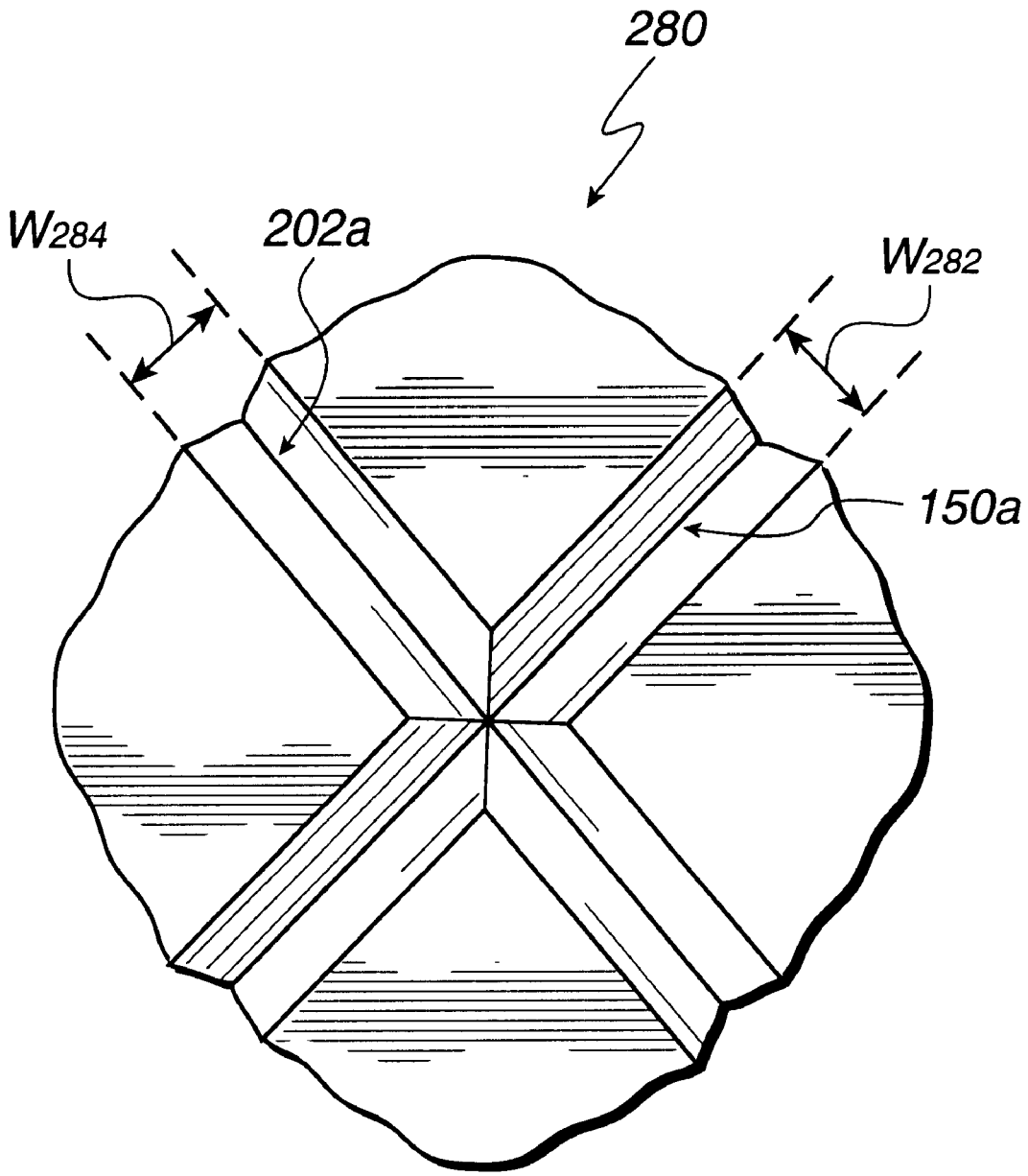
FIG. 3C shows a portion illustrating a magnified view of the first set of spiral grooves and the first set of lateral channels.

FIG. 3C shows a portion 280 illustrating a magnified view of the first set of spiral grooves 150*a* and the first set of lateral channels 202*a*. The first set of spiral grooves 150*a* and the second set of spiral grooves 150*b* (as shown in FIG. 3A) may be any suitable width that enables optimal fluid removal and grip of the polishing belt. In one embodiment, the first set of spiral grooves 150*a* and the second set of spiral grooves 150*b* may have a width $w_{282}$ of between about 0.05 inch and about 0.5 inch, and preferably about 0.125 inch.

The first set of lateral channels 202*a* and the second set of lateral channels 202*b* (shown in FIG. 3A) may be any suitable width that allows optimal fluid removal and grip of the polishing belt. In one embodiment, the lateral channels 202*a* and 202*b* may have a width $w_{284}$ of between about 0.05 inch and about 0.50 inch, and preferably about 0.125 inch.

It should be appreciated that the grooves 150 and the lateral channels 202 may be in any suitable configuration and arrangement that would enable fluid removal from an interface between the roller 160 and the polishing pad 156 while at the same time evening the tension across the polishing pad 156. In one embodiment, the first set of lateral channels 202*a* and a first set of spiral grooves 150*a* are in a first portion of the surface of the roller 160, and the second set lateral channels 202*b* and the second set of spiral grooves 150*b* are in a second portion of the surface of the roller 160. The first set of lateral channels 202*a* and the first set of spiral grooves 150*a* may cross each other, and the second set of lateral channels 202*b* and the second set of spiral grooves 150*b* may cross each other. Therefore, by having the lateral channels 202 and the grooves 150, fluid may be optimally removed from the lateral channels 202 through the edges of the roller 160 as well as from along the grooves 150 of the roller 160.

Figure 3D:
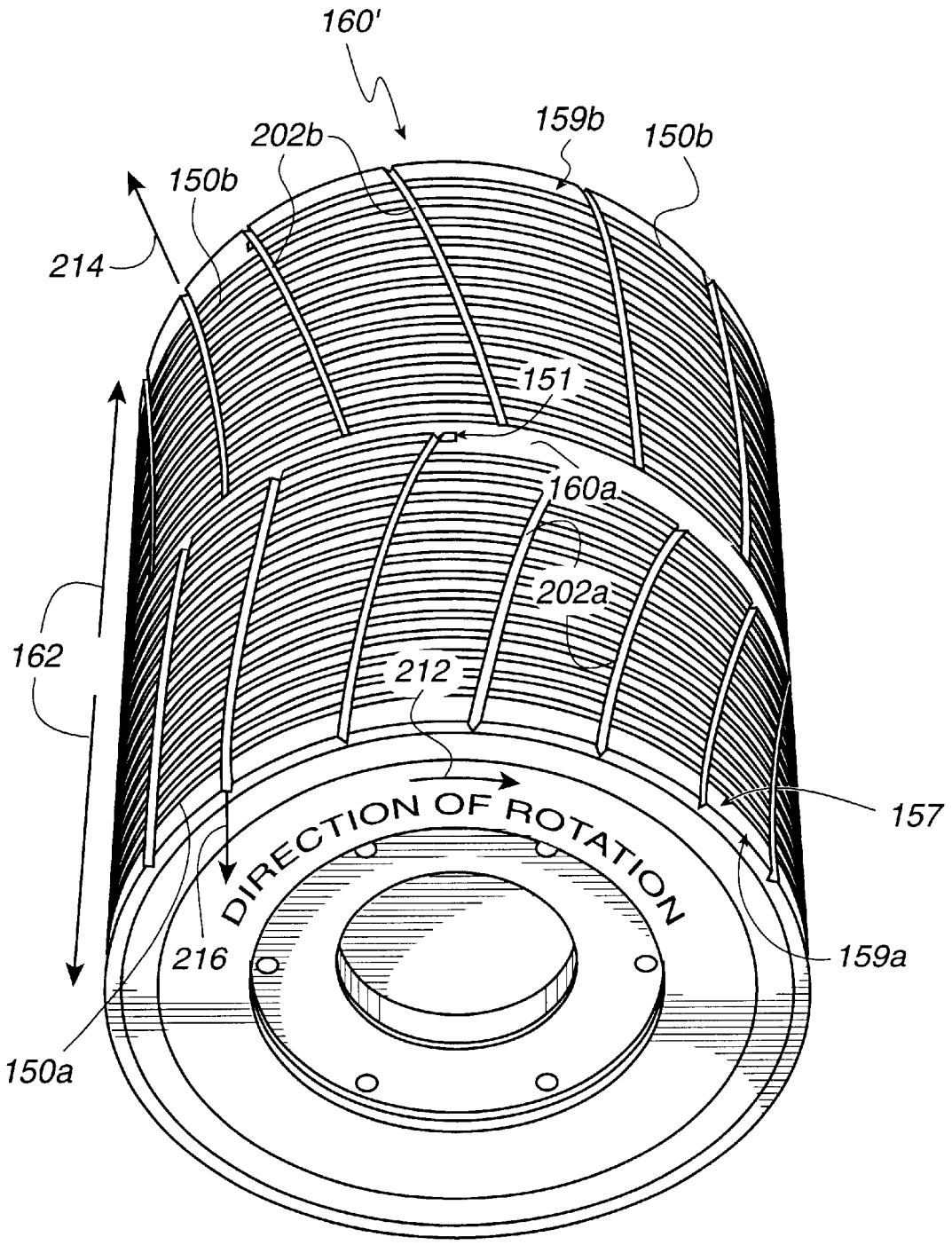
FIG. 3D shows a detailed three dimensional view of a roller with the roller groove pattern in accordance with one embodiment of the present invention.

FIG. 3D shows a detailed three dimensional view of a roller 160' with the roller groove pattern 200 in accordance with one embodiment of the present invention. In this embodiment, the roller 160' includes the first set of spiral grooves 150*a* and the second set of spiral grooves 150*b* as well as the first set of lateral channels 202*a* and the second set of lateral channels 202*b*. In this embodiment, the roller 160' may be utilized as one or both of the rollers 160*a* and 160*b* in a CMP apparatus 114 as described in reference to FIG. 2A. By using roller 160', fluids may be evacuated and grip maintained on a polishing pad even when large pressures are exerted on a wafer.

Figure 4:
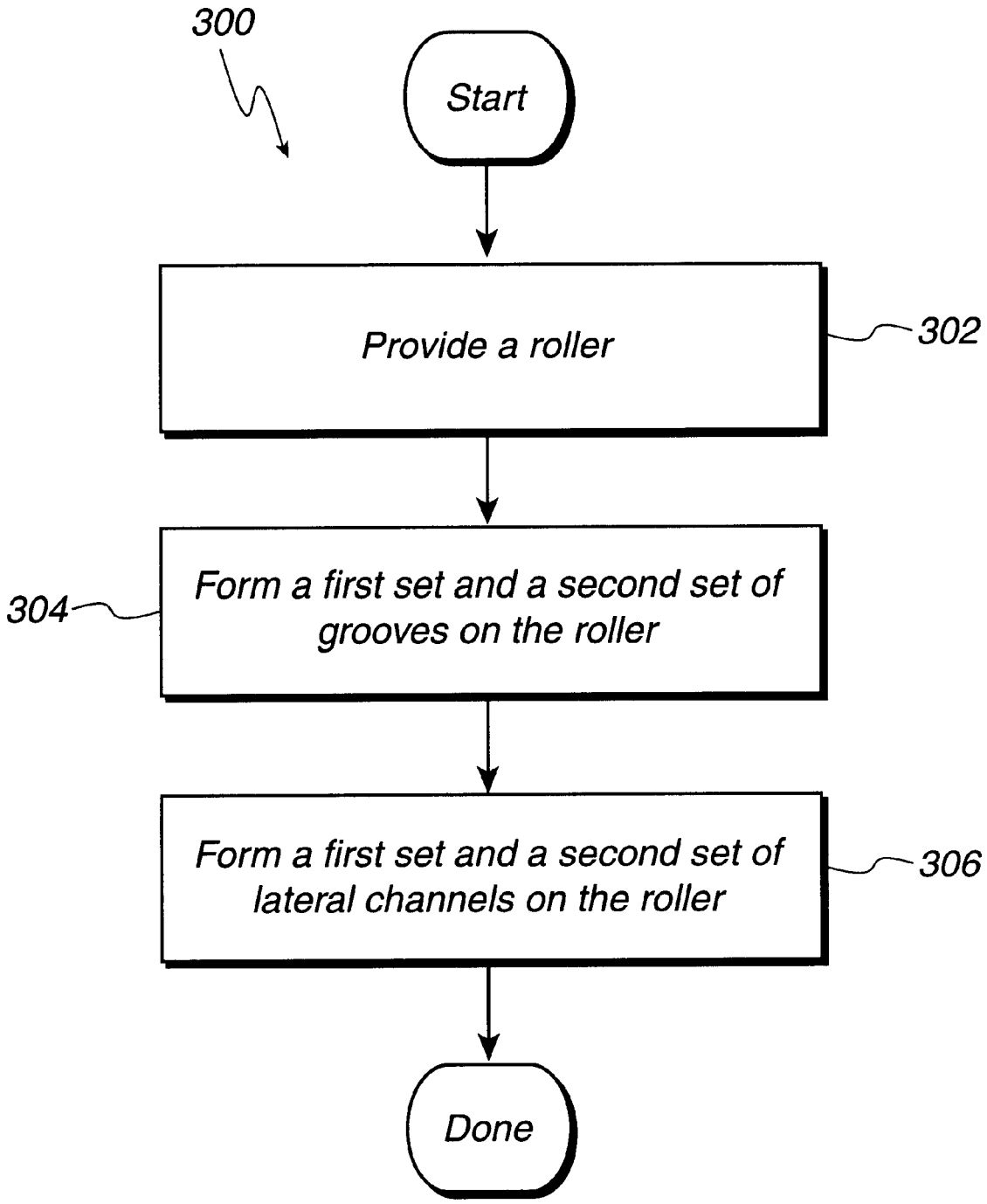
FIG. 4 illustrates a flow chart showing a method for generated a grooved roller with lateral channels in accordance with one embodiment of the present invention.

FIG. 4 illustrates a flow chart 300 showing a method for generated a grooved roller with lateral channels in accordance with one embodiment of the present invention. The method begins with operation where a roller is provided. The roller may be any suitable roller that may be utilized to rotate a polishing belt in a linear CMP apparatus. In one embodiment, the roller is configured to operate in a 200 mm wafer linear CMP apparatus. In another embodiment, the roller is configured to operate in a 300 mm wafer linear CMP apparatus. It should be appreciated that the roller may be made from any suitable material that may be durable and have an ability to grip the polishing belt such as, for example, polyurethane, rubber, etc.

After operation 302, the method moves to operation 304 where a first set and a second set of grooves are formed on an outside surface of the roller. In this operation, grooves configured as the first and second set of spiral grooves 150*a* and 150*b* as discussed in reference to FIGS. 2A to 3C are formed on the roller. It should be understood that the grooves may be formed on the roller in any suitable manner such as, for example, machining, molding, etc.

Then the method moves to operation 306 where a first set and a second set of lateral channels are formed on an outside surface of the roller. In this operation, the lateral channels configured as the first set of lateral channels 202*a* and the second set of lateral channels 202*b* as discussed in reference to FIGS. 3A to 3C are formed on the roller. It should be understood that the lateral channels may be formed on the roller in any suitable manner such as, for example, machining, molding, etc.

In summary, due to the strategic placement and intelligent use of spiral grooves and lateral channels on a roller, optimal grip may be exercised by the roller on a polishing pad while averaging out tension across the polishing belt thereby significantly enhancing consistency in CMP operations.

While this invention has been described in terms of several preferred embodiments, it will be appreciated that those skilled in the art upon reading the preceding specifications and studying the drawings will realize various alterations, additions, permutations and equivalents thereof. It is therefore intended that the present invention includes all such alterations, additions, permutations, and equivalents as fall within the true spirit and scope of the invention.

What is claimed is:

1. In a linear chemical mechanical planarization (CMP) system, including a linear belt and a pair of rollers, the linear belt configured to loop around each of the pair of rollers, the pair of rollers designed to drive the linear belt to enable planarization of a substrate, a surface of each roller of the pair of rollers comprising:

a first set of grooves covering a first portion of the surface of the roller, the first set of grooves having a first pitch that angles outwardly toward a first outer edge of the roller;

a second set of grooves covering a second portion of the surface of the roller, the second set of grooves having a second pitch that angles outwardly toward a second outer edge of the roller, the second pitch angling away from the first pitch;

a first set of lateral channels arranged along the first portion; and a second set of lateral channels arranged along the second portion, the first set of lateral channels configured to cross the first set of grooves, and the second set of lateral channels configured to cross the second set of grooves.

2. In a linear chemical mechanical planarization (CMP) system, a surface of each roller of the pair of rollers as recited in claim 1, wherein the first set of grooves and the second set of grooves are between about 0.05 inch and about 0.50 inch in depth.

3. In a linear chemical mechanical planarization (CMP) system, a surface of each roller of the pair of rollers as recited in claim 1, wherein the first set of grooves and the second set of grooves are between about 0.05 inch and about 0.50 inch in width.

4. In a linear chemical mechanical planarization (CMP) system, a surface of each roller of the pair of rollers as recited in claim 1, wherein the first set of lateral channels and the second set of lateral channels are between about 0.05 inch and about 0.5 inch in width.

5. In a linear chemical mechanical planarization (CMP) system, a surface of each roller of the pair of rollers as recited in claim 1, wherein the first set of lateral channels and the second set of lateral channels are between about 0.05 inch and about 0.5 inch in depth.

6. In a linear chemical mechanical planarization (CMP) system, a surface of each roller of the pair of rollers as recited in claim 1, wherein the first set of grooves has a first pitch of between about 0.2 inch and about 2 inches, and the second set of grooves has second pitch of between about 0.2 inch and about 2 inches.

7. In a linear chemical mechanical planarization (CMP) system, a surface of each roller of the pair of rollers as recited in claim 1, wherein the first set of grooves spirals toward a first edge of the roller and the second set of grooves spirals toward a second edge of the roller.

8. A method for generating a grooved roller for use a linear chemical mechanical planarization (CMP) system, comprising:

providing a roller;

forming a first set and a second set of grooves on an outside surface of the roller, the first set of grooves covering a first portion of the surface of the roller, the first set of grooves having a first pitch that angles outwardly toward a first outer edge of the roller, the second set of grooves covering a second portion of the surface of the roller, the second set of grooves having a second pitch that angles outwardly toward a second outer edge of the roller, the second pitch angling away from the first pitch; and forming a first set and a second set of lateral channels on an outside surface of the roller, the first set of lateral channels arranged along the first portion, and the second set of lateral channels arranged along the second portion, the first set of lateral channels configured to cross the first set of grooves, and the second set of lateral channels configured to cross the second set of grooves.

9. A method for generating a grooved roller for use a linear chemical mechanical planarization (CMP) system as recited in claim 8, wherein the first set of grooves and the second set of grooves are between about 0.05 inch and about 0.5 inch in depth.

10. A method for generating a grooved roller for use a linear chemical mechanical planarization (CMP) system as recited in claim 8, wherein the first set of grooves and the second set of grooves are between about 0.05 inch and about 0.50 inch in width.

11. A method for generating a grooved roller for use a linear chemical mechanical planarization (CMP) system as recited in claim 8, wherein the first set of lateral channels and the second set of lateral channels are between about 0.05 inch and about 0.5 inch in width.

12. A method for generating a grooved roller for use a linear chemical mechanical planarization (CMP) system as recited in claim 8, wherein the first set of lateral channels and the second set of lateral channels are between about 0.05 inch and about 0.5 inch in depth.

13. A method for generating a grooved roller for use a linear chemical mechanical planarization (CMP) system as recited in claim 8, wherein the first set of grooves has a first pitch of between about 0.2 inch and about 2 inches, and the second set of grooves has second pitch of between about 0.2 inch and about 2 inches.

14. A method for generating a grooved roller for use a linear chemical mechanical planarization (CMP) system as recited in claim 8, wherein the first set of grooves spirals toward a first edge of the roller and the second set of grooves spirals toward a second edge of the roller.

15. An apparatus for optimizing linear chemical mechanical planarization (CMP) operations, comprising:

a cylindrical roller, the cylindrical roller being configured to rotate a polishing belt in a CMP system;

a first set of grooves defined on an outside surface of the cylindrical roller, the first set of grooves having a first groove initiation point at a center portion of the cylindrical roller and spiraling around the cylindrical roller at least one time to a first ending point at a first edge area of the cylindrical roller;

a second set of grooves defined on the outside surface of the cylindrical roller, the second set of grooves having a second groove initiation point at the center portion different from the first groove initiation point of the cylindrical roller, the second set of grooves spiraling around the cylindrical roller at least one time to a second ending point at a second edge area different from the first edge area of the cylindrical roller;

a plurality of lateral channels being defined on the outside surface of the cylindrical roller, the plurality of lateral channels extending at an angle from the center portion of the cylindrical roller to an edge of the cylindrical roller;

wherein the plurality of lateral channels and the first set and the second set of spiral grooves are configured to remove fluid from an interface between the cylindrical roller and the polishing belt when the cylindrical roller rotates the polishing belt, and the first set and the second set of spiral grooves being configured to apply a consistent tension pattern across a width of the polishing belt when the cylindrical roller rotates the polishing belt.

16. An apparatus for optimizing linear chemical mechanical planarization (CMP) operations as recited in claim 15, wherein the first set of grooves and the second set of grooves are between about 0.05 inch and about 0.5 inch in depth.

17. An apparatus for optimizing linear chemical mechanical planarization (CMP) operations as recited in claim 15, wherein the first set of grooves and the second set of grooves are between about 0.05 inch and about 0.5 inch in width.

18. An apparatus for optimizing linear chemical mechanical planarization (CMP) operations as recited in claim 15, wherein the first set of lateral channels and the second set of lateral channels are between about 0.05 inch and about 0.5 inch in width.

19. An apparatus for optimizing linear chemical mechanical planarization (CMP) operations as recited in claim 15, wherein the first set of lateral channels and the second set of lateral channels are between about 0.05 inch and about 0.5 inch in depth.

20. An apparatus for optimizing linear chemical mechanical planarization (CMP) operations as recited in claim 15, wherein the first set of grooves has a first pitch that angles outwardly toward a first outer edge of the roller, and the second set of grooves having a second pitch that angles outwardly toward a second outer edge of the roller, the second pitch angling away from the first pitch.

21. An apparatus for optimizing linear chemical mechanical planarization (CMP) operations as recited in claim 15, wherein the first set of grooves has a first pitch of between about 0.5 inch and about 40 inches, and the second set of grooves has second pitch of between about 0.5 inch and about 40 inches.

* * * * *